US005703437A

United States Patent [19]

Komaki

[11] Patent Number: 5,703,437

[45] Date of Patent: Dec. 30, 1997

[54] AC PLASMA DISPLAY INCLUDING PROTECTIVE LAYER

[75] Inventor: Toshihiro Komaki, Koufu, Japan

[73] Assignee: Pioneer Electronic Corporation, Tokyo, Japan

[21] Appl. No.: 816,883

[22] Filed: Mar. 13, 1997

Related U.S. Application Data

[63] Continuation of Ser. No. 506,965, Jul. 28, 1995, abandoned.

[30] Foreign Application Priority Data

Aug. 31, 1994 [JP] Japan ..... 6-207038

[51] Int. Cl.[6] ..... H01J 1/48; H01J 17/04

[52] U.S. Cl. ..... 313/587; 313/586; 313/489

[58] Field of Search ..... 313/484, 485, 313/486, 489, 584, 586, 587

[56] References Cited

U.S. PATENT DOCUMENTS 3,935,494 1/1976 Dick et al. ..... 313/587
3,993,921 11/1976 Robinson ..... 313/586
4,454,449 6/1984 Hall ..... 313/584
4,578,619 3/1986 Braude ..... 313/586
4,853,590 8/1989 Andreadakis ..... 313/485

*Primary Examiner*—Michael Horabik
*Assistant Examiner*—Michael Day
*Attorney, Agent, or Firm*—Morgan, Lewis & Bockius LLP

[57] ABSTRACT

An AC plasma display includes a plurality of parallel column electrodes (14); a plurality of parallel row electrodes (21) disposed from, and perpendicular to, the column electrodes (14); a dielectric layer (17) for forming a wall charge is made of a low dielectric constant glass having a low melting point includes sodium oxide and boron oxide and covers the column electrodes (14); and an electrode protective layer (16) made from an inorganic material, for example silicon dioxide, prevents diffusion of sodium from the dielectric layer (17) to the column electrode (14). The dielectric layer (17) is made of a glass having a low dielectric constant of 8 or less to reduce pixel capacitance thereby reducing the electrical power consumption of the display.

4 Claims, 3 Drawing Sheets

AC PLASMA DISPLAY INCLUDING PROTECTIVE LAYER

This application is a continuation of application Ser. No. 08/506,965, filed Jul. 28, 1995, now abandoned.

BACKGROUND OF THE INVENTION

1. Field of the Invention

The invention relates to an AC type plasma display apparatus.

2. Description of the Related Art

Recent years, a plasma display panel such as an AC type plasma display apparatus is excepted to be a large thin color display apparatus.

FIG. 1 shows an example of a surface discharge AC type plasma display panel. This plasma display panel comprises a front side substrate 1 having column electrodes 2 and 2 and a back side substrate 5 having row electrodes 6. A plurality of pairs of the electrodes 2 and 2 as sustaining electrodes are formed in parallel on the glass substrate 1 of a display side. A dielectric layer 3 and a MgO layer 4 is formed in turn on the electrodes 2 and 2. Moreover, the row electrodes 6 are formed on the back side glass substrate 5 as address electrodes. A fluorescent layer 7 is formed on the row electrodes 6. The plasma display panel is constructed in such a manner that the front side substrate 1 and the back side substrate 5 are assembled and sealed with a gap so that the row electrodes 6 are disposed perpendicular to the sustaining electrodes 2 to define a discharge region 8 in the gap. After exhausting the discharge region 8, a rare gas is introduced and sealed into the discharge region 8. In this way, a pixel of a unit cell is formed at each intersection between each electrode 2 of the substrate 1 and each electrode 6 of the substrate 5. The plasma display panel is capable of displaying an image by a plurality of the pixels driven by a driving circuit.

In case of the displaying of the above plasma display panel, a discharge-starting voltage or higher voltage is applied across the electrodes 2 and 6 to the introduced and sealed rare gas in the selected pixel, so that a discharge occurs on the MgO layer 4 to emit light. This discharge-starting voltage is selected on the basis of the gap distance between the substrates 1 and 5, the kinds of introduced and sealed inert gas and the pressure thereof and the properties of the dielectric layer 3 and the MgO layer 4. The charges of anions and electrons transfer to the internal wall of the pixel in the opposite polarization directions to each other during the application of the discharge-starting voltage so as to charge the internal wall in a manner that the MgO layer 4 is divided into two opposite polarization regions. The wall charges remain on the MgO layer 4 because of a high resistance value thereof without decrement. This discharge is stopped immediately after emitting light by these wall charges because the electric field is weakened due to the formation of the electric field of the inverse polarization in the pixel.

The discharge is intermittently maintained by the application of the discharge sustaining voltage across the electrodes 2 and 2 in which the discharge sustaining voltage is an AC driving voltage and lower than a discharge-starting voltage because of the wall charge. This is referred to as a memory function of the plasma display panel. The selection of the dielectric layer 3 is important for the determination of the AC driving voltage in the pixel.

It is well known to use lead oxide (PbO) for the dielectric layer 3.

In such a plasma display panel, the discharge at the starting of discharge is stopped immediately after emitting light because of the charge transfer in the pixel. Since a dielectric layer 3 of PbO has a large dielectric constant of 9 to 12, the amount of discharge current flowing in the pixel is large per one emission of light and therefore the consumed electric power of the plasma display panel is also large.

Therefore, it has been attempted to make the dielectric layer 3 of $SiO_2$ with a low dielectric constant in order to reduce the pixel's capacity. A problem with such a method is that it is difficult to form the $SiO_2$ films of 20 to 30 microns thick since the $SiO_2$ layer is formed by a vacuum method or sputtering method. Another problem is that there is also an occurrence of cracks in a thick $SiO_2$ layer.

SUMMARY OF THE INVENTION

In view of the problems, an object of the present invention is to provide an AC type plasma display apparatus which reduces the consumed electric power thereof.

An AC type plasma display apparatus according to the present invention comprises:

a plurality of column electrodes disposed in parallel to each other;

a plurality of row electrodes spaced from and disposed perpendicular to said column electrodes;

a dielectric layer covering said column electrodes and charging a wall charge wherein said dielectric layer is made of a low melting point glass having a dielectric constant of 8 or less.

The AC type plasma display apparatus according to the present invention achieves the above object, since the dielectric layer has a dielectric constant of 8 or less. That is, the pixel's capacity in the intersection between the column electrode and the row electrode becomes small. Therefore, the consumed electric power per one discharge is reduced by the decrease of the amount of discharge current flowing in the emitting plasma display panel.

The above and other objects, features and advantages of the invention will become apparent from the following detailed description which is to be read in conjunction with the accompanying drawings.

DETAILED DESCRIPTION OF THE PREFERRED EMBODIMENTS

An embodiment of a plasma display panel according to the present invention will be described hereinbelow with reference to FIGS. 2 and 3.

Figure 2:
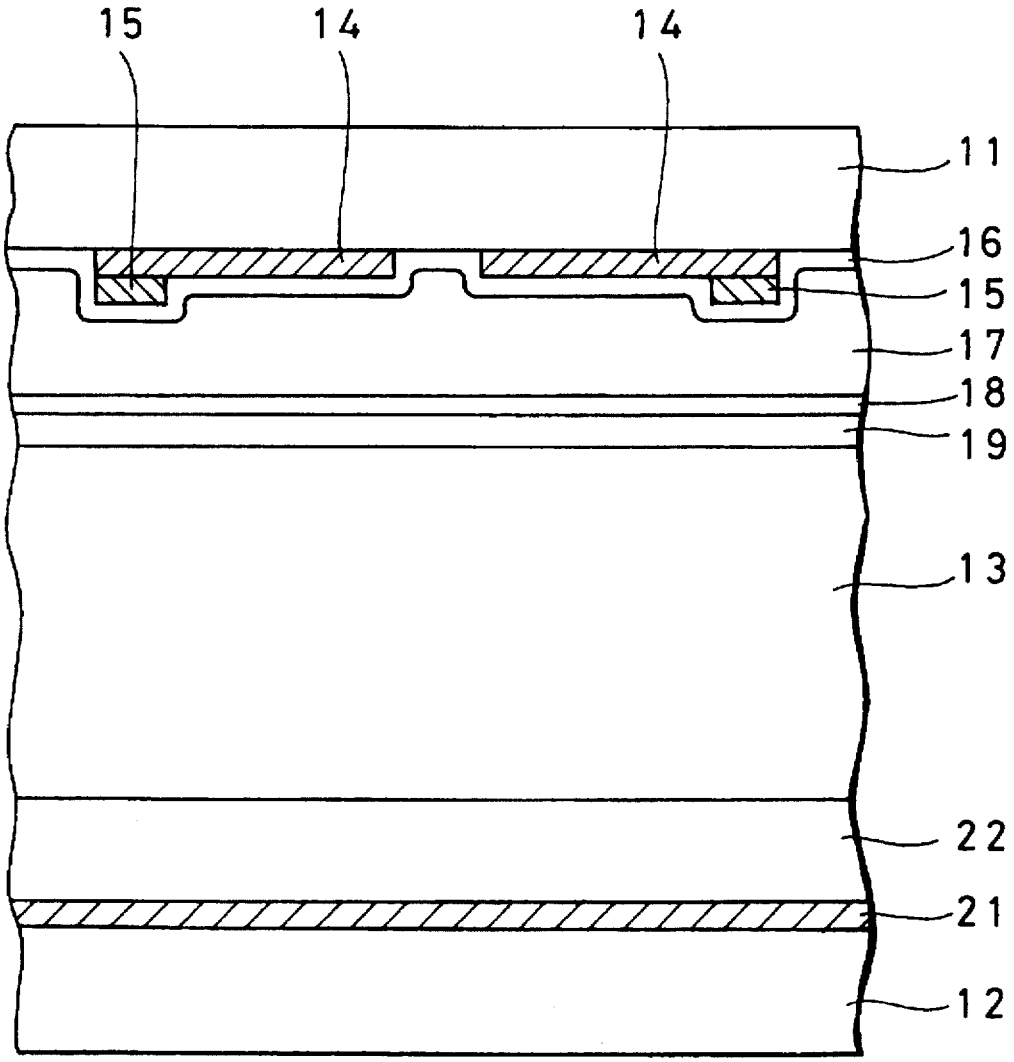
FIG. 2 is a partially enlarged cross-sectional view showing an AC type plasma display panel according to the present invention.

FIG. 2 is a cross-sectional view showing one of a plurality of pixels which form a surface discharge AC type plasma display panel employing a three-electrode structure. This pixel includes a front side transparent substrate 11 of glass as a display surface; and a back side glass substrate 12 disposed in parallel to the front side substrate 11 at a gap space of 100 to 200 microns. For maintaining the gap, barrier ribs (not shown) are formed between the front side substrate 11 and the back side substrate 12. The front side substrate 11, the back side substrate 12 and a pair of the barrier ribs define and surround a space as a discharge region 13.

The front side substrate 11 has a plurality of pairs of transparent electrodes 14 and 14 as column electrodes on its surface facing the back side substrate 12 in such a manner that the column electrodes extend in parallel to each other. The pair of column electrodes serve as control electrodes for driving the pixel and are formed of a transparent conductive material, such as indium tin oxide (ITO), tin oxide ($SnO_2$) or the like with a thickness of about several hundreds nm order by using a vacuum deposition method. For improving the conductance of the whole electrodes, metal auxiliary electrodes 15 are formed on and along the far opposite edges of the transparent electrodes 14 and 14 respectively to the adjacent edges thereof. The metal auxiliary electrodes 15 are made of Aluminum (Al) and each has a width narrower than that of the column electrode 14. An electrode protective layer 16 is formed on the pair of column electrodes 14 and 14 and the metal auxiliary electrodes as covering them at a thickness of 0.1 to 0.2 microns. A dielectric layer 17 is formed on the protective layer 16 at a thickness of 20 to 50 microns. A protective layer 18 made of $SiO_2$ is formed on the dielectric layer 17 at a thickness of about several hundreds nm order. A MgO layer 19 made of magnesium oxide (MgO) is formed on the protective layer 18 at a thickness of about several hundreds nm order.

The dielectric layer 17 is made of a low melting point glass having a softening point of 650° C. or less and a dielectric constant of 8 or less. The dielectric layer 17 of the low melting point glass contains sodium oxide ($Na_2O$) and boron oxide ($B_2O_3$) as components. Some examples of the low melting point glass are shown in the following table 1 in which low melting point glasses denoted by glass-codes (Product Numbers) are commercially available from Nihonn Denki Garasu kabusiki kaisya.

TABLE 1

| Glass-code | Components | Softening point (°C.) | Dielectric constant |
|---|---|---|---|
| GA-4 | $Na_2O$—$B_2O_3$—$SiO_2$ | 625 | 6.2 |
| GA-12 | $Na_2O$—$B_2O_3$—ZnO | 560 | 6.7 |
| LS-0500 | $Na_2O$—$B_2O_3$—$SiO_2$ | 585 | 7.6 |

The electrode protective layer 16 is made of an inorganic material different from that of the dielectric layer 17, such as a glass containing lead oxide (PbO) and/or silicon dioxide ($SiO_2$), to protect the electrodes 14. The electrode protective layer 16 is formed in order to prevent from the internal dispersion of sodium (Na) from the dielectric layer 17 to the electrodes 14 and 15. This is because an alkali glass of the dielectric layer 17 with a low melting point contains sodium (Na) which causes a corrosion of the electrodes 14 and 15. It is noted that the protective layer 18 may be omitted.

On the other hand, the back side substrate 12 has a plurality of addressing electrodes 21 as row electrodes on its surface facing the front side substrate 11 in such a manner that the row electrodes extend in parallel to each other. The row electrodes also serve as sustaining electrodes for driving the pixel and are formed of a high reflectance metal such as Al and Al alloy at a thickness of about 1 microns by using a vacuum deposition method. The row electrodes 21 made of a high reflectance metal such as Al and Al alloy have a reflectance of 80% or more in a wavelength band of 380 to 650 nm. It is noted that the row electrodes 21 may be made of not only Al and Al alloy, but also an appropriate metal or alloy thereof having a higher reflectance such as Cu, Au and an alloy thereof.

The barrier ribs (not shown) are formed between the row electrodes 21 on the back side substrate 12 to define and surround spaces as discharge regions.

The row electrodes 21 and the exposed surface of the back side substrate 12 are covered with a fluorescent layer 22 for a monochrome plasma display panel. In case of a color plasma display panel, three fluorescent layers made of fluorescent substances for emitting red (R), green (G) and blue (B) lights are formed in turn on the corresponding row electrodes 21 respectively, so that each pixel emits light correspondingly to the fluorescent substance.

The back side substrate 12 and the front side substrate 11 are assembled in such a manner that the row electrodes 21 are perpendicular to the column electrodes 14. After assembled, the intersections with a gap between the column electrodes 14 and 14 and the row electrodes 21 define discharge regions 13 for the emitting regions of pixels. The front side substrate 11 and the back side substrate 12 are fixed to each other and the gap of the discharge regions 13 is exhausted by a vacuum pump. After that, the assembly is baked so that the surface of the MgO layer 19 is activated. Next, an inert mixture gas including a rare gas of xenon (Xe) at 1 to 10% is introduced and sealed into the discharge regions 13 at a pressure of 200 to 600 Torr.

In the conditions that the plasma display panel is driven, a pulse voltage for controlling the starting of the emission of light, and of sustaining the emission and of stopping the emission of light is supplied to the column electrodes 14 and 14. A data pulse for an image to be displayed including data starting the emission of light and sustaining the emission and stopping the emission is supplied to the row electrode 21.

Figure 1:
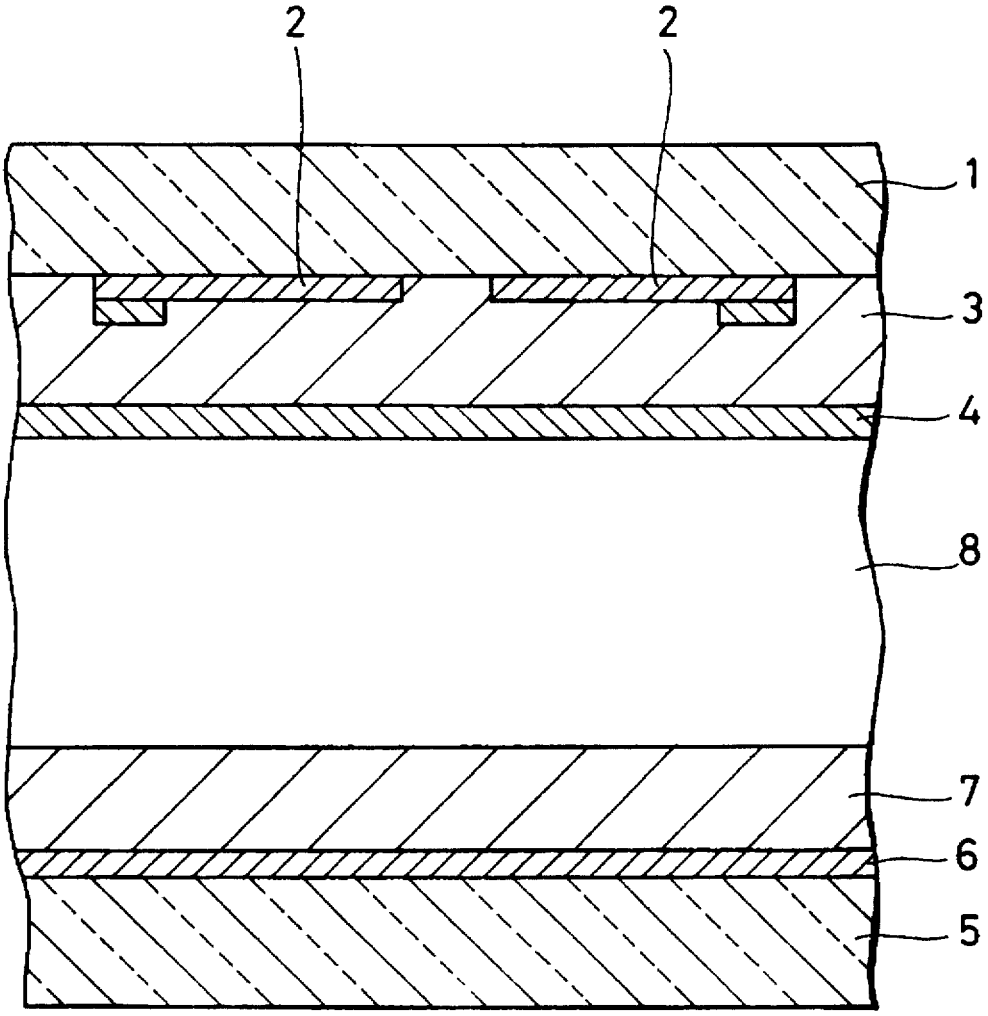
FIG. 1 Prior Art
FIG. 1 is a partially enlarged cross-sectional view showing a conventional AC type plasma display panel.

An operation of the plasma display panel will be described. The embodiment (A) according to the present invention of FIG. 2 is compared to a comparative embodiment comprising a dielectric layer of PbO with the structure shown in FIG. 1.

The following table 2 shows components and dielectric constants of the dielectric layers 17 and 5 in the embodiment (A) and the comparative embodiment. In the table 2, low melting point glasses denoted by glass-codes (Product Numbers) are commercially available from Nihonn Denki Garasu kabusiki kaisya.

TABLE 2

| | Glass-code | Components | Dielectric constant |
|---|---|---|---|
| Embodiment(A) | GA-12 | $Na_2O$—$B_2O_3$—ZnO | 6.7 |
| Comparative | PLS3232 | PbO—$B_2O_3$—$SiO_2$ | 10 |

Each thickness of the dielectric layers 17 and 5 of the embodiment (A) and comparative are 30 micron meters. Both the display panels are formed in the same manner excepting the materials of the dielectric layers 17 and 5 and the electrode protective layer 16.

Next, amount of discharge current flowing in the emitting plasma display panel of the present invention is compared with that of the comparative embodiment. FIG. 3 shows curves of variations of discharge currents flowing in the emitting pixels of both the plasma display panels as a function of time under the conditions that a sustaining voltage 170 V is applied across the column electrodes to discharge pixels once. In FIG. 3, curve a represents the variation of the embodiment A and curve b shows that of the comparative embodiment.

Figure 3:
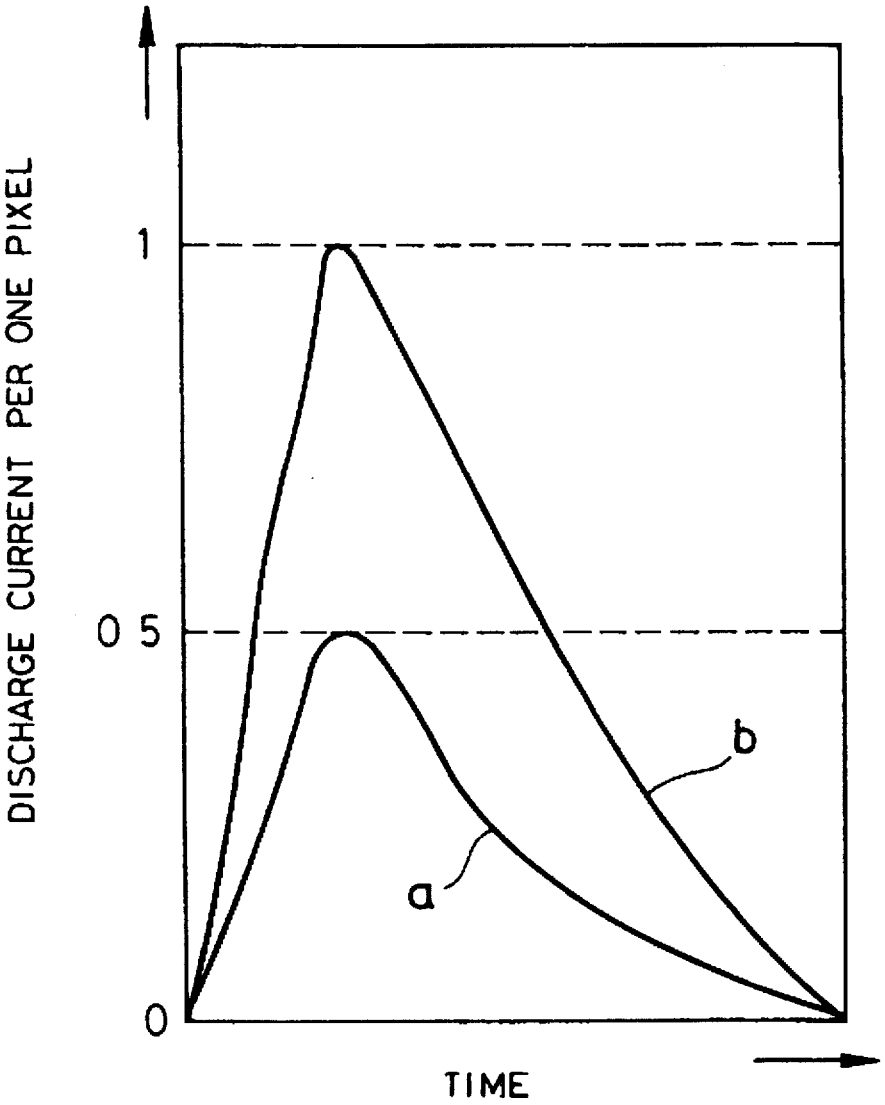
FIG. 3 is a graph showing a result from the comparison in the amount of discharge current per one pixel both of an AC type plasma display panel according to the present invention and a conventional plasma display panel.

As seen from FIG. 3, the amount of discharge current of the embodiment A and comparative embodiment reach peak values at substantially the same time respectively, during the application of the sustaining voltage. However, the peak of the embodiment A is about ½ of the peak of the comparative embodiment. The flows of discharge current of the embodiment A and comparative embodiment are terminated at substantially the same time respectively. The reason for this is as follows: The capacity C of the pixel is represented by the following equation:

$$C=\epsilon\cdot\epsilon_0\ (S/D)$$

wherein $\epsilon$ denotes a dielectric constant, $\epsilon_0$ denotes the permittivity in vacuum, S denotes an area of the electrode and D denotes a gap distance between the electrodes. Namely, the pixel's capacity C is in proportion to the dielectric constant $\epsilon$ of the dielectric layer and thus, as decreasing the dielectric constant $\epsilon$ of the dielectric layer, the pixel's capacity C decreases. Therefore, the capacity of pixel of the embodiment A is smaller than that of the comparative embodiment because of the above equation under the conditions that the dielectric constant $\epsilon$ of the dielectric layer 17 in the embodiment A is 6.7 and that of comparative embodiment is 10. As a result, the amount of discharge current flowing in the emitting plasma display panel of the present invention is less than that of the comparative embodiment under the application of the same voltage across the electrodes.

The reduction of permittivity in the layer covering the electrode makes the consumed electric power in the embodiment A decrease rather than that of the comparative embodiment, since the amount of discharge current flowing in the emitting plasma display panel of embodiment A is smaller than that of the comparative embodiment.

In addition, the dielectric layer 17 is preferably formed with a thickness in the range of 20 to 50 microns. This is because a destruction of insulation may occur when the dielectric layer 17 is formed with a thickness less than 20 microns so as to reduce the durability against the applied voltage across the electrodes 14 and 14. When the dielectric layer 17 is formed with a thickness of 30 microns, its durability against the applied voltage is about 1 kV. Furthermore, when the dielectric layer 17 is formed with a thickness 50 microns or more, the discharge-starting voltage becomes 400 V or more so as to make a difficulty of controlling the driving circuit for the plasma display panel. Therefore, the preferred thickness range of the dielectric layer 17 is within 20 microns or more and 50 microns or less.

In this way, the above embodiment is described as a surface discharge AC type plasma display panel which comprises the front side substrate having the column electrodes and the back side substrate having the row electrodes. In addition to this embodiments, not restrictive, the present invention may be applied to an opposite AC type plasma display panel in which the column and row electrodes are formed with a space in one substrate, and furthermore to all of AC type plasma display panels in which the electrodes for discharge are covered with dielectric layers.

According to the present invention, the AC type plasma display apparatus comprises a dielectric layer made of a low melting point glass having a dielectric constant of 8 or less, so that the pixel's capacity in the intersection between the column electrode and the row electrode become small. As a result, the consumed electric power per one discharge is reduced by the decrease of the amount of discharge current flowing in the emitting plasma display panel.

What is claimed is:

1. An AC type plasma display apparatus comprising:

a plurality of column electrodes;

a plurality of row electrodes spaced from said column electrodes;

a dielectric layer coveting said column electrodes and charging a wail charge, wherein said dielectric layer is made of a low melting point glass including sodium oxide and boron oxide and having a dielectric constant of 8 or less; and an electrode protective layer to prevent an internal dispersion of sodium from said dielectric layer to said column electrodes, the electrode protective layer being made of an inorganic material and disposed between said column electrodes and said dielectric layer.

2. An AC type plasma display apparatus according to claim 1, wherein said dielectric layer has a thickness in the range of 20 to 50 microns.

3. An AC type plasma display apparatus according to claim 1, wherein said column electrodes are disposed in parallel to each other and said row electrodes are disposed perpendicular to said column electrodes.

4. An AC type plasma display apparatus according to claim 1, wherein said low melting point glass has a softening point of 650° C. or less.

* * * * *

UNITED STATES PATENT AND TRADEMARK OFFICE

CERTIFICATE OF CORRECTION

PATENT NO. : 5,703,437

DATED : December 30, 1997

INVENTOR(S) : Toshihiro KOMAKI

It is certified that error appears in the above-identified patent and that said Letters Patent is hereby corrected as shown below:

Column 6, line 29, change "coveting" to --covering--.

Column 6, line 30, change "wail" to --wall--.

Signed and Sealed this

Sixteenth Day of February, 1999

*Attest:*

*Attesting Officer*

*Acting Commissioner of Patents and Trademarks*